United States Patent [19]

Rothfuss et al.

[11] Patent Number: 4,978,108

[45] Date of Patent: Dec. 18, 1990

[54] GAS WASHING SINK WITHOUT INTEGRAL CLOSURE MEMBER

[75] Inventors: Hans Rothfuss, Taunusstein; Raimund Brückner, Engenhahn-Niedernhausen; Peter Keutgen, Kreuzau; Josef Seeger, Düren; Manfred Winkelmann, Krefeld; Herbert Metzger, Duisburg, all of Fed. Rep. of Germany

[73] Assignee: Didier-Werke AG, Weisbaden, Fed. Rep. of Germany

[21] Appl. No.: 413,671

[22] Filed: Sep. 28, 1989

[30] Foreign Application Priority Data

Oct. 1, 1988 [DE] Fed. Rep. of Germany ..... 3833502

[51] Int. Cl.[5] ..... C21C 5/48

[52] U.S. Cl. ..... 266/220; 266/265

[58] Field of Search ..... 266/217, 220, 265, 270; 222/603

[56] References Cited

U.S. PATENT DOCUMENTS 3,618,917 11/1971 Fredrikson et al. ..... 266/220
4,899,992 2/1990 Thrower et al. ..... 266/220

FOREIGN PATENT DOCUMENTS 105868 4/1984 European Pat. Off. .
137961 4/1985 European Pat. Off. .
181853 5/1986 European Pat. Off. .
1608036 12/1970 Fed. Rep. of Germany .
3716920 12/1988 Fed. Rep. of Germany .
WO88/06191 8/1988 PCT Int'l Appl. .

*Primary Examiner*—S. Kastler
*Attorney, Agent, or Firm*—Wenderoth, Lind & Ponack

[57] ABSTRACT

A gas washing sink for use in introducing gas through a metallurgical vessel into molten metal therein includes a gas permeable refractory inner brick portion and a gas impermeable refractory outer brick portion surrounding the inner brick portion. The inner and outer brick portions define a first sink end to be exposed to the molten metal. The outer brick portion has an end face defining a second sink end to be directed away from the molten metal. A gas distribution chamber has a first end open to the inner brick portion and a second end opening onto the end face of the outer brick portion and defined thereat by an opening. A sealing surface extending concentrically of the opening has pressed thereagainst, at a pressure sufficient to achieve a seal therebetween, a closure member for closing the second end of the gas distribution chamber and having a gas inlet connection for introducing gas into the gas distribution chamber.

19 Claims, 3 Drawing Sheets

GAS WASHING SINK WITHOUT INTEGRAL CLOSURE MEMBER

BACKGROUND OF THE INVENTION

The present invention relates to a gas washing or purging stone or sink including a gas permeable refractory inner brick portion, a gas impermeable refractory outer brick portion surrounding the inner brick portion, and a gas distribution chamber. The present invention also relates to an assembly of such gas washing or purging stone or sink and a closure member having an integral gas inlet connection and detachably connected to or mounted against the gas purging or washing stone or sink to close the gas distribution chamber.

Gas purging, flushing or washing stones or sinks are used for introducing gas through a metallurgical vessel into a molten metal therein, for various purposes as would be understood by one skilled in the art. For example, such devices are disclosed in DE-PS 36 23 609 (corresponding to U.S. Pat. No. 4,779,849). In known such devices the gas distribution chamber is closed by means of a bottom plate that is permanently connected to the gas washing stone or sink, with a gas inlet connection being integral with such bottom plate. To form the gas distribution chamber, the bottom plate must be mounted and maintained at a specific distance from the gas permeable refractory inner brick portion of the gas washing sink. Thus, this known gas washing sink includes a number of integral metal parts and therefore is expensive. When the gas washing sink must be replaced, as inevitably occurs, the bottom plate and gas inlet connection also must be replaced since they are integral components of the gas washing sink, even though such metal components could be used again. This is an inherently expensive practice.

SUMMARY OF THE INVENTION

Accordingly, it is an object of the present invention to provide an improved gas purging, flushing or washing stone, brick or sink whereby it is possible to overcome the above and other prior art disadvantages.

It is a more specific object of the present invention to provide such an improved gas washing sink that does not include an integral bottom plate or closure member and gas inlet connection, such that when the gas washing sink has to be replaced it is not necessary to also replace the closure member and gas inlet connection.

It is a further object of the present invention to provide an assembly including such improved gas washing sink as well as a closure member for closing the gas distribution chamber, the closure member having connected thereto a gas inlet connection for introducing gas through the closure member into the gas distribution chamber, the closure member being formed separately of the gas washing sink and having seal means for tightly pressing against a sealing surface of the gas washing sink.

These objects are achieved in accordance with the present invention by the provision of a gas washing sink including a gas permeable refractory inner brick portion, a gas impermeable refractory outer brick portion surrounding the inner brick portion, the inner and outer brick portions defining a first sink end to be exposed to the molten metal, the outer brick portion having an end face defining a second sink end to be directed away from the molten metal, a gas distribution chamber having a first end open to the inner brick portion and a second end opening onto the end face of the outer brick portion and defined thereat by an opening, and means, associated with the outer brick portion and defining a sealing surface extending concentrically of the opening, for enabling the sealing surface to have pressed thereagainst, at a pressure sufficient to achieve a seal therebetween, a closure member for closing the second end of the gas distribution chamber and having a gas inlet connection for introducing gas into the gas distribution chamber.

In accordance with these features of the present invention, the gas washing sink does not include either an integral bottom plate forming the closure member to close the gas distribution chamber nor the gas inlet connection. In operation, the closure member is pressed very tightly against the sealing surface to form therewith a suitable seal. In other words, the arrangement is such that the closure member essentially is force locked against the outer brick portion, or at least a member abutting the outer brick portion. However, since the closure member is not an integral portion of the structure of the gas washing sink, when the sink must be replaced, the closure member and the gas inlet connection readily are removable from the sink to be discarded and can be used again with a new sink. As a result, the construction of the sink itself is very significantly simplified, since the sink does not include an integral bottom plate having welded thereto a gas inlet connection. Additionally, the sink of the present invention can be transported and stored much more easily than known sinks since the sink of the present invention does not have a gas inlet connection projecting therefrom. Also, the weight of the sink is reduced.

BRIEF DESCRIPTION OF THE DRAWINGS

Other objects, advantages and specific details and features of construction will be apparent from the following description, taken with the accompanying drawings, wherein.

DETAILED DESCRIPTION OF THE INVENTION

Figure 1:
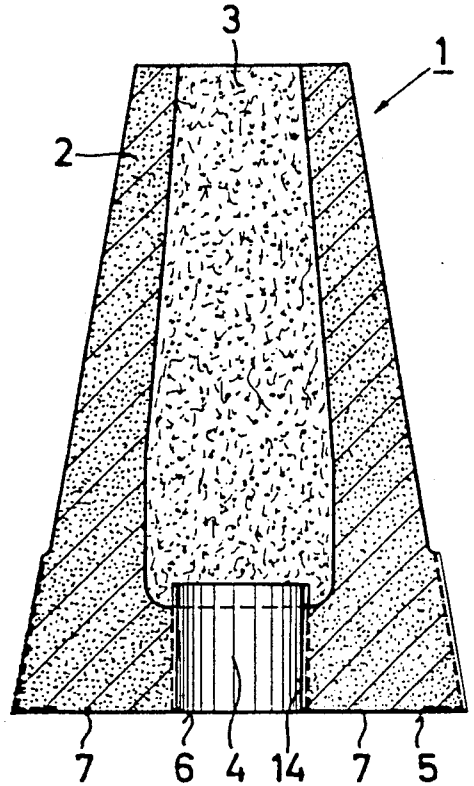
FIG. 1 is a cross-sectional view of an improved gas purging or washing stone or sink in accordance with one embodiment of the present invention.

In FIG. 1 is illustrated a gas washing sink according to one embodiment of the present invention and including a gas permeable refractory inner brick portion 3 and a gas impermeable refractory outer brick portion 2 surrounding inner brick portion 3. The inner and outer portions 3, 2 define a first sink end (the upper end in FIG. 1) to be exposed to molten metal in a metallurgical vessel. The outer brick portion 2 has an end face 5 defining a second sink end to be directed away from the molten metal. A gas distribution chamber 4 has a first end open to the inner brick portion 3 and a second end opening onto end face 5 of outer brick portion 2 and defined thereat by an opening 6. Gas distribution chamber 4 is at least partially defined by an inner surface 14 of the outer brick portion 2.

The gas impermeability of outer brick portion 2 may be achieved in any manner known in the art, for example by means of dense refractory material, such as chemically or hydraulically curable or binding ceramic compounds with closed pores. The gas permeability of inner brick portion 3 may be achieved by means of any known porous component that would be understood by one skilled in the art, for example permeable stones, capillary rinsers, labyrinth rinsers, or disc rinsers. The composition of the materials of the portions 2, 3 of the sink 1 do not themselves form the present invention and are contemplated to include known compositions that readily would be understood by one skilled in the art.

Gas distribution chamber 4 essentially is formed in outer brick portion 2 and has a cylindrical configuration arranged concentrically to the longitudinal axis of the sink 1, conventionally formed with a conical or frustoconical outer surface as illustrated.

In accordance with the present invention the sink has means, associated with the outer brick portion 2 and defining a sealing surface extending concentrically of opening 6 for enabling the sealing surface to have pressed thereagainst, at a pressure sufficient to achieve a seal therebetween, a closure member 11 (FIGS. 2 and 3) for closing the second end of gas distribution chamber 4. In the embodiment of FIG. 1, the sealing surface 7 is formed on end face 5 to extend annularly around opening 6. Also, as illustrated in FIG. 1, opening 6 has an area extending over the entire cross section of gas distribution chamber 4. Thus, the gas washing sink 1 of the present invention does not include an integral structure closing the outer end of the gas distribution chamber 4. Furthermore, the sink 1 of the present invention does not include a gas inlet connection.

Figure 2:
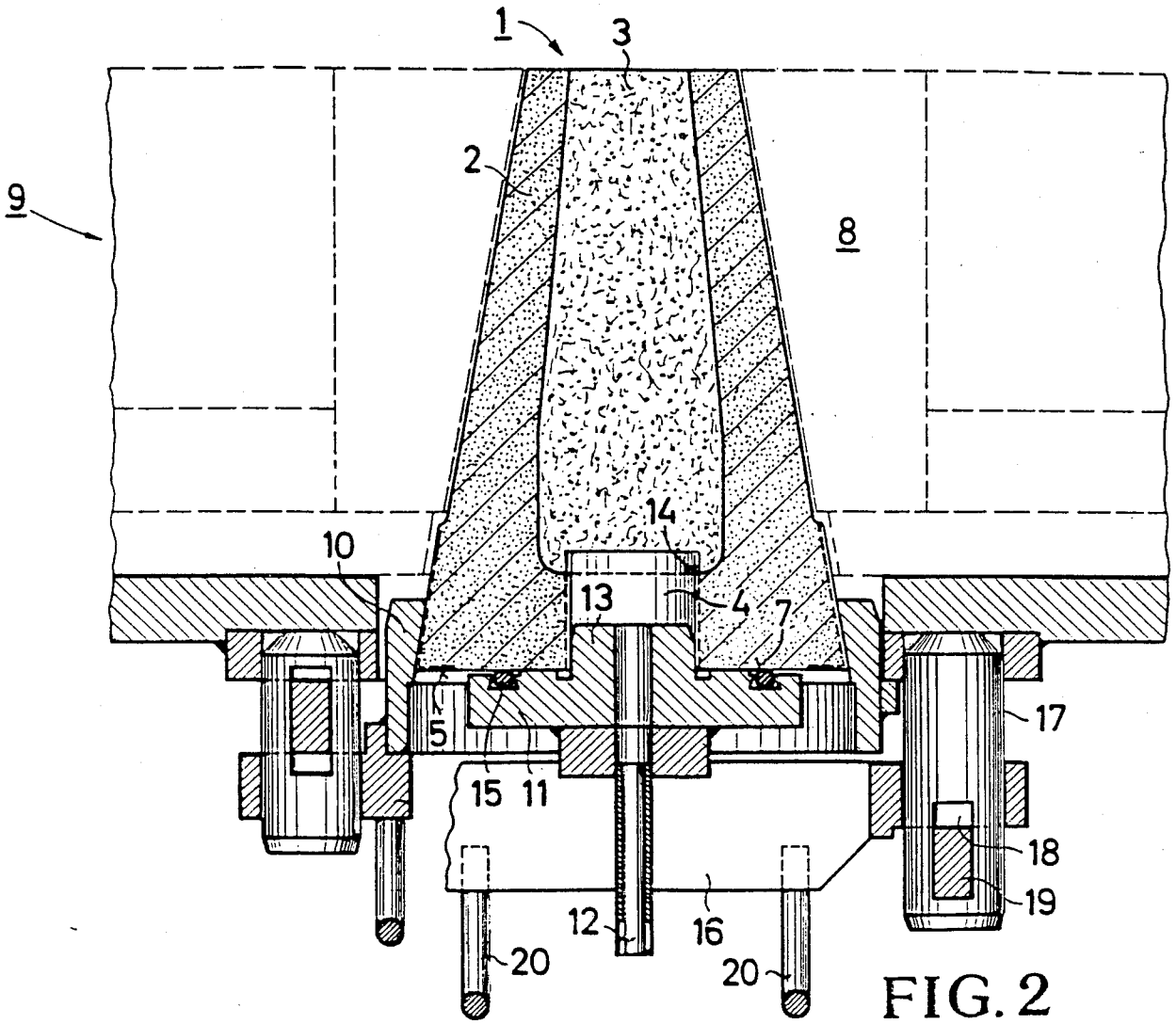
FIG. 2 is a cross-sectional view illustrating the sink of FIG. 1 mounted in the bottom of a metallurgical vessel, and also illustrating a closure member and gas inlet connection, as well as one manner of mounting of such elements.

FIG. 2 illustrates the use of the sink 1 of FIG. 1. Specifically, a bottom 9 of a metallurgical vessel to contain molten metal includes a perforated bottom brick 8 in a known manner. The sink 1 of the present invention is inserted into perforated brick 8. A closure member 11 in accordance with a further aspect of the present invention has connected thereto a gas inlet connection 12. Closure member 11 has an integral seal ring 15 that abuts sealing surface 7 as well as a centering projection 13 that extends into gas distribution chamber 14. Closure member 11 is not integrally connected to sink 1 but is pressed against sealing surface 7 at a pressure sufficient to achieve a seal therebetween. This is achieved in an essentially force locking manner by structure illustrated somewhat schematically in FIG. 2. This structure itself is not a part of the present invention, but rather is part of an invention disclosed in an application filed concurrently herewith, assigned to the assignee of the present application, and entitled "APPARATUS FOR MOUNTING A GAS WASHING SINK IN A CENTERED MANNER IN A PERFORATED BRICK" (Ref: 59/PA3809). The disclosure of such application is incorporated herein by reference. Briefly, such structure includes a centering ring 10 extending about the periphery of the outermost portion of sink 1. A cross member 16 is mounted on a pair of rods 17 (only one of which is illustrated) and is slidable thereon toward and away from sink 1. Closure member 11 is mounted on or abutted by cross member 16. Rods 17 have therein cross slots 18 into which may be inserted respective wedges 19 to force cross member 16, and thereby closure member 11, toward sink 1 to create a force locking seal between closure member 11 and the sink 1, in the manner discussed above, i.e. between sealing ring 15 and sealing surface 7. Cross member 16 has handles 20 to enable, upon removal of wedges 19, cross member 16, and thereby closure member 11, to be moved away from sink 1. When the sink and closure member are in the operative position shown in FIG. 2, gas may be introduced through gas inlet connection 12 to pass through closure member 11 into gas distribution chamber 14. The gas then passes through gas permeable inner brick portion and into molten metal thereabove. When sink 1 becomes worn or eroded, then it may be replaced in a relatively easy manner without the need for replacing closure member 11 and gas inlet connection 12. Thus, upon downward movement of cross member 16, closure member 11 and gas inlet connection 12 are removed from sink 1. Thereafter, in a manner disclosed in the above concurrently filed application, centering ring 19 is moved outwardly to thereby remove the worn sink 1 from the bottom 9 of the metallurgical vessel.

Figure 3:
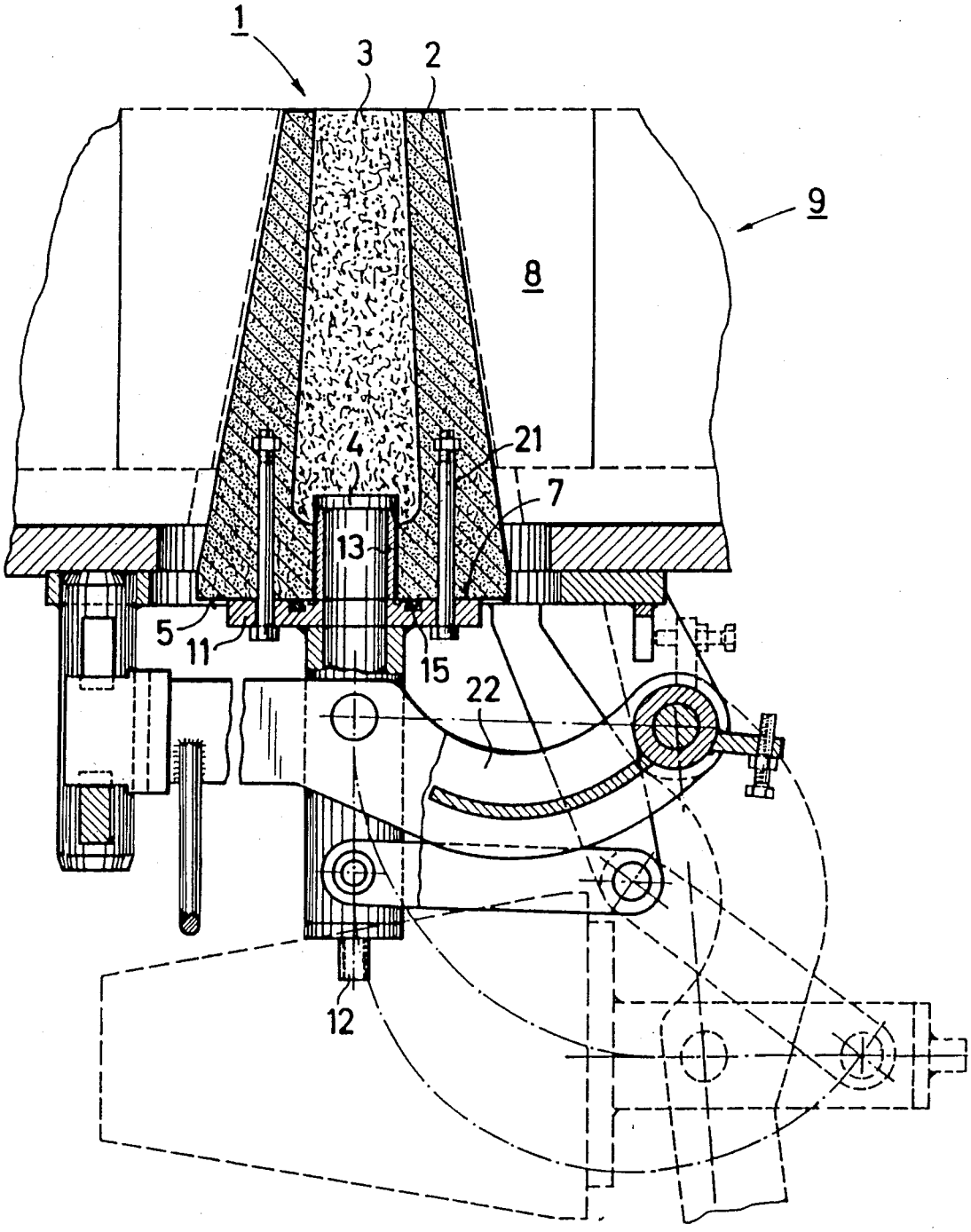
FIG. 3 is a view similar to FIG. 2 but illustrating an alternative manner of detachably mounting the closure member to the sink, as well as a different arrangement for mounting such elements in a metallurgical vessel.

In FIG. 3 is illustrated an alternative arrangement of detachably coupling closure member 11 and gas inlet connection 12 to the sink 1. In this embodiment, such detachable coupling is achieved by removable bolt assemblies 21 that extend into the refractory material of the outer brick portion 2. It will be apparent that bolt assemblies 21 force sealing ring 15 against sealing surface 7 in a force locking manner. It also will be apparent that, upon removal of the sink 1 from the bottom 9 of the metallurgical vessel, bolt assemblies 21 can be removed, such that a worn sink 1 can be replaced and the closure member 11 and gas inlet connection 12 can be reused. FIG. 3 also illustrates an alternative structure for mounting the closure member and sink and for removal thereof from the bottom of the metallurgical vessel. This structure however is not a portion of the present invention but rather is the invention disclosed in the above mentioned concurrently filed application. Briefly, such structure includes a swivel device 22 employed to remove the closure member 11 and sink 1 from the bottom 9 of the metallurgical vessel, whereupon the worn sink may be replaced by a new sink and then the structure 22 may be employed to insert the new sink into the bottom of the metallurgical vessel.

The present invention is not intended to be limited to the mounting structures shown in FIGS. 2 and 3. Rather, the improved gas washing sink and the improved assembly of the gas washing sink and closure member according to the present invention may be mounted to a metallurgical vessel by any other structure capable of achieving the manner of operation and advantages disclosed herein. In any case, the closure member 11 that closes the outer end of gas distribution chamber 4 and the gas inlet connection 12 connected to closure member 11 easily can be disconnected or removed from the sink 1 and reused with other sinks.

Figure 4:
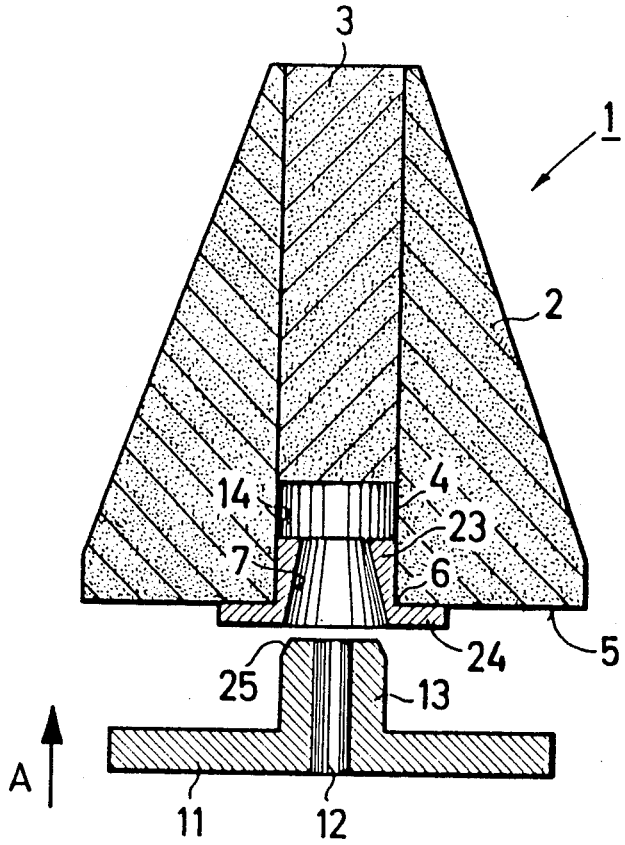
FIG. 4 is a cross-sectional view illustrating another embodiment of a sink in accordance with the present invention.

FIG. 4 illustrates another embodiment of a gas washing sink in accordance with the present invention. In this embodiment, a sleeve 23 is inserted into gas distribution chamber 4. Sleeve 23 is made of a material, for example copper, which is less hard than the material of closure member 11. Sleeve 23 has an inner surface that is conical and converges toward the interior of gas distribution chamber 4. In this embodiment of the present invention, this inner surface of sleeve 23 forms the sealing surface 7. Sleeve 23 has an outer flange 24 that abuts end face 5. In the event that the sink of this embodiment has an outer shell or jacket, then sleeve 23 can be enclosed by and permanently connected to such shell or jacket.

FIG. 4 also illustrates the feature that the projection 13 of closure member 11 has a beveled outer edge 25. Closure member 11 is forced, in the direction of arrow A (i.e. in a direction transverse to the plane of opening 6), into sleeve 23. Sleeve 23, being of a softer material, thereby is compressed such that the closure member forms a tight seal with sealing surface 7. The embodiment of FIG. 4 has the advantage that the pressure acting on sealing surface 7 does not have to be generated or maintained, during use of the device, by the structure that holds the closure member 11 in position. In other words, forcing the projection 13 of the closure member 11 into the sleeve 23 creates a permanent seal that does not have to be maintained by the structure, such as shown in FIG. 2 and 3, that positions the closure member 11. Thus, an improved seal is provided without the requirement of a high force to maintain contact between the closure member and the sink. Thus, the sleeve 23 essentially is a component of the sink and is replaced therewith.

In the above described embodiments of the present invention the gas sink is not provided with an outer shell or jacket, for example of metal. However, it is contemplated that the sink of the present invention could include such an outer shell or jacket. If such shell or jacket includes a portion fitting over end face 5, then the sealing surface 7 would be formed on such portion of the shell or jacket. It particularly would be advantageous to provide such a shell or jacket around the periphery of the outer brick portion 2 contacted by the centering ring 10 illustrated in FIG. 2. Thus, the transfer of forces from the centering ring to the sink would be improved with less risk of damage or fracture to the refractory material of the outer brick portion 2. In such a case, the outer metal shell or jacket could be designed to perform the function of centering ring 10 so that centering ring 10 could be eliminated as a separate component. It also would be possible to connect this part of a shell or jacket directly to the closure member 11, for example by means of a bayonet-type connection. In such an arrangement, the bolt assemblies 21 shown in FIG. 3 would be unnecessary.

Although the present invention has been described and illustrated with respect to preferred features thereof, it is to be understood that various modifications and changes may be made to such specifically described and illustrated features without departing from the scope of the present invention.

We claim:

1. A gas washing sink for use in introducing gas through a metallurgical vessel into molten metal therein, said sink being capable of operation in association with a closure member having a gas inlet connection to enable gas to be supplied to said sink, and said sink being replaceably removably mountable in the metallurgical vessel independently of the closure member, whereby the closure member need not be replaced upon replacement of said sink, said sink comprising:

a gas permeable refractory inner brick portion;

a gas impermeable refractory outer brick portion surrounding said inner brick portion, said outer brick portion being of integral, one-piece construction;

said inner and outer brick portions defining a first sink end to be exposed to the molten metal;

said outer brick portion having an end face defining a second sink end to be directed away from the molten metal;

a gas distribution chamber extending through a part of said outer brick portion and having a first end open to said inner brick portion and a second end opening onto said end face of said outer brick portion and defined thereat by an opening; and means, associated with said outer brick portion and defining a sealing surface extending concentrically of said opening, for enabling said sealing surface to have pressed thereagainst the closure member, at a pressure sufficient to achieve the sole necessary seal between said sink and the closure member, for sealingly closing said second end of said gas distribution chamber, such that upon removal of the closure member and gas inlet connection said sink may be replaced without the need for replacement of the closure member and gas inlet connection.

2. A sink as claimed in claim 1, wherein said outer brick portion has a frusto-conical outer surface converging toward said first sink end.

3. A sink as claimed in claim 1, wherein said opening extends over the entire cross-sectional area of said gas distribution chamber.

4. A sink as claimed in claim 1, wherein said gas distribution chamber has a cylindrical configuration and is located concentrically within said sink.

5. A sink as claimed in claim 1, wherein said sealing surface is located on said end face.

6. A sink as claimed in claim 1, wherein said means defining said sealing surface is located inwardly of said gas distribution chamber.

7. A sink as claimed in claim 6, wherein said means defining said sealing surface comprises a sleeve extending through said opening into said gas distribution chamber, said sleeve having an outer surface abutting an inner surface of said outer brick portion defining said gas distribution chamber, and said sleeve having an inner surface defining said sealing surface.

8. A sink as claimed in claim 7, wherein said inner surface of said sleeve converges inwardly thereof.

9. A sink as claimed in claim 7, wherein said sleeve is formed of a material softer than the material of the closure member.

10. A sink as claimed in claim 9, wherein said sleeve is formed of copper.

11. A sink as claimed in claim 1, wherein said gas distribution chamber is defined by an inner surface of said outer brick portion that forms a guide surface for insertion therein of a projection to extend from the closure member.

12. A sink as claimed in claim 1, further comprising a jacket surrounding at least part of said outer brick portion and forming means for detachable connection to the closure member.

13. An assembly for use in introducing gas through a metallurgical vessel into molten metal therein said assembly comprising:

a refractory sink replaceably removably mountable in the metallurgical vessel, said sink comprising:

a gas permeable refractory inner brick portion;

a gas impermeable refractory outer brick portion surrounding said inner brick portion, said outer brick portion being of integral, one-piece construction;

said inner and outer brick portions defining a first sink end to be exposed to the molten metal;

said outer brick portion having an end face defining a second sink end to be directed away from the molten metal;

a gas distribution chamber extending through a part of said outer brick portion and having a first end open to said inner brick portion and a second end opening onto said end face of said outer brick portion and defined thereat by an opening; and means, associated with said outer brick portion, for defining a sealing surface extending concentrically of said opening; and a closure member comprising:

a gas inlet connection for introducing gas into said gas distribution chamber; and seal means for being pressed against said sealing surface at a pressure sufficient to achieve the sole necessary seal between said sink and said closure member, thereby sealingly closing said second end of said gas distribution chamber;

whereby, upon removal of said closure member and gas inlet connection, said sink may be replaced independently of said closure member and without the need for replacement of said closure member and gas inlet connection.

14. An assembly as claimed in claim 13, wherein said sealing surface is on said end face, and said seal means comprises a sealing ring mounted on said closure member.

15. An assembly as claimed in claim 14, further comprising connector means for detachably mounting said closure member on said end face of said sink such that said sealing ring is tightly pressed against said sealing surface.

16. An assembly as claimed in claim 15 wherein said connector means comprises bolts extending through said closure member into said outer brick portion.

17. An assembly as claimed in claim 13, wherein said closure member abuts said end face of said outer brick portion.

18. An assembly as claimed in claim 13, wherein said closure member includes a projection extending into said gas distribution chamber.

19. An assembly as claimed in claim 18, wherein said projection has a beveled outer edge.

* * * * *